US005318670A

United States Patent [19]

Link et al.

[11] Patent Number: 5,318,670

[45] Date of Patent: Jun. 7, 1994

[54] METHOD FOR THE GENERATION OF SMOOTHNESS AND GLOSS OF A PAPER WEB

[75] Inventors: Christof Link, Weingarten; Wolf-Gunter Stotz, Ravensburg, both of Fed. Rep. of Germany

[73] Assignee: Sulzer-Escher Wyss GmbH, Ravensburg, Fed. Rep. of Germany

[21] Appl. No.: 926,741

[22] Filed: Aug. 6, 1992

[30] Foreign Application Priority Data

Aug. 8, 1991 [DE] Fed. Rep. of Germany ..... 4126233

[51] Int. Cl.[5] ..... D21G 1/00; D21H 25/04

[52] U.S. Cl. ..... 162/206; 100/38; 100/93 RP; 162/207

[58] Field of Search ..... 162/206, 207; 100/38, 100/93 RP

[56] References Cited

U.S. PATENT DOCUMENTS

| | | | |
|---|---|---|---|
| 3,647,619 | 3/1972 | Mack et al. | 162/206 |
| 4,016,030 | 4/1977 | Sobota | 162/206 |
| 4,274,915 | 6/1981 | Munari | 162/206 |
| 4,606,264 | 8/1986 | Agronin | 162/206 |
| 4,624,744 | 11/1986 | Vreeland | 162/206 |
| 4,653,395 | 3/1987 | Verkasalo | 162/206 |
| 4,738,197 | 4/1988 | Malkia | 100/93 RP |
| 5,033,373 | 7/1991 | Brendel et al. | 162/206 |
| 5,245,920 | 9/1993 | Hess | 162/206 |

FOREIGN PATENT DOCUMENTS

| | | |
|---|---|---|
| 0341457 | 11/1989 | European Pat. Off. . |
| 3815446A1 | 11/1989 | Fed. Rep. of Germany . |
| WO90/07027 | 6/1990 | PCT Int'l Appl. . |
| 1540056 | 2/1979 | United Kingdom . |

*Primary Examiner*—Karen M. Hastings

*Attorney, Agent, or Firm*—Townsend and Townsend Khourie and Crew

[57] ABSTRACT

The invention has as its object the provision of a method and an apparatus for the generation of smoothness and gloss on paper which essentially precludes a re-erection of the surface fibers after the smoothing process. This is achieved in that the surface of a paper web (1) to be smoothed is heated to a temperature above the glass transition temperature of the fibers at the surface of the web without subjecting the web to a press nip, and then these fibers are deformed and fixed in the deformed state in a subsequent process step under the simultaneous action of pressure with shock cooling. Accordingly, there is associated with each surface of the paper web (1) to be smoothed a heating device (2) and also a subsequent cooled body (5, 9, 10) which presses against the surface.

4 Claims, 1 Drawing Sheet

METHOD FOR THE GENERATION OF SMOOTHNESS AND GLOSS OF A PAPER WEB

FIELD OF INVENTION

The invention concerns a method and an apparatus for the generation of smoothness and gloss at one or both surfaces of a paper web comprising natural cellulose fibers, through the application of pressure and through the use of heating and subsequent cooling. The term natural cellulose fibers will be understood by those skilled in the art to mean natural fibers as used in conventional papermaking and derived from sources such as wood, grass, cotton, sugar cane (bagasse), reed and bambus, optionally with a proportion of recycled material, predominantly natural cellulose-based material.

BACKGROUND OF INVENTION

There have been very many different prior art proposals for methods and apparatus for the generation of smoothness and gloss at the surface of paper webs. One typical modern proposal is to be found in European patent application publication No. 245 250. This prior art application describes a process for producing gloss and smoothness on a surface of a paper web by providing a finishing apparatus comprising a smooth metal finishing drum and a resilient backing roll pressed against the drum at a force up to 700 KN/M (4000 pounds/linear inch) to form a nip with pressure against the paper of at least 13,780 KN/M$^2$ (2000 pounds/-square inch). The web of papermaking fibers having a moisture content of from 3% to 7% of the bone dry weight of the fibers is advanced through the nip between the smooth metal finishing drum and the resilient backing roll at a speed which results in the web dwelling in the nip from 0.3 millisecond to 12 milliseconds. During this the drum is heated to a surface temperature having a value no less than 20° below a value determined by a complicated exponential formula involving the initial temperature of the web just prior to entering the nip, the dwell time of the web in the nip and the moisture content of the fibers in the web in weight percent of the bone dry fiber weight.

Typical of this process and of other prior art processes is the heating of the web in the nip between two rollers with simultaneous compression of the web in this nip.

The aforementioned European paten application also recognizes that cellulosic fibers, such as papermaking fibers, appear to exhibit thermoplastic properties and in particular appear to have a glass transition temperature "Tg" above which the fibers become much more flexible and moldable when subjected to pressing forces. It is noted in this reference that the Tg of cellulose in paper is greatly dependent upon the moisture content of the paper. The disclosure of this reference is incorporated herein by reference as far as it relates to the properties of papermaking materials with respect to their glass transition temperature and the effect of their moisture content thereon.

Another reference which teaches a method of generating smoothness and gloss on a paper web is described in European patent application with the publication number 0 341 457.

The calender arrangement described here includes two roll pairs defining respective nips through which the paper web runs in series. Each roll pair is used to treat a respective surface of the web and comprises a high temperature hard roll and a soft roll. As seen in the direction of movement of the paper web a respective cooling device precedes each roll pair and serves the purpose of cooling the web prior to it being heated in the roll gaps. The aim is to restrict the heating of the interior of the paper web in the roll gaps and thus the associated partial plastification of the interior of the paper web. In this way the heating is restricted to the surface of the web so that the surface fibers remain compressed after the web leaves the roll gap. It can be seen from the foregoing description that this reference also teaches a method of generating smoothness and gloss where the surfaces of the web are smoothed using heated rolls with the simultaneous application of pressure.

A further prior art reference in this field is German Offenlegungsschrift DE-OS 38 15 446. This reference is directed to the generation of smoothness and gloss by a rubbing effect on the surface of the paper web. More specifically the reference discloses an apparatus for generating smoothness and gloss on webs of paper, textile and the like and includes a polished metal smoothing surface along which the web can be moved under the action of pressure and friction. The movement of the web along the surface can be effected by means of a roll with a resilient coating. Through the polished smoothing surface the surface of the web is effectively ironed smooth. It is explained in the reference that the effect which generates smoothness and gloss relates to a plastification of the fiber layers of the web close to the surface. In order to enhance the effect that is sought, it is said to be of advantage for the web to be moistened and/or heated at the side to be smoothed. In particular it is recommended that the smoothing surface and/or the roll should be subjected to temperature control during the smoothing process, i.e. heated or cooled, with the temperature control taking place in dependence on the heat which is in any event generated by friction at the smoothing surface and which can be considerable. That is to say the cooling of the polished metal smoothing surface which is effected from the rear is intended not to cool the surface of the web but rather to prevent the smoothing surface from being overheated as a result of the friction that is generated. DE-OS 38 15 446 describes various types of heating arrangement, for example a radiative heating device which heats the rear side of a sheet metal smoothing surface along which the web is drawn, and a preheated roll which heats the surface of the web prior to it entering into the gap between the smoothing surface and the roll with the resilient coating. In some embodiments a cooling device is provided for cooling the paper web after it has been smoothed. As will be seen from the foregoing this reference again relates to a method in which the smoothness is generated by the simultaneous application of heat and pressure to one or both surfaces of the paper web.

It is disadvantage of the above described so-called temperature gradient methods that the roll temperature or the press forces must be increased to ensure adequate smoothness or gloss because of the increasingly shorter swell time in the roll gap which is brought about by the high speeds of production plants of over 1000 m/min. However, an increase of the press forces leads to a reduction of the web thickness which is often undesired. Furthermore, even when smoothing is carried out with heated rolls, it can be observed that the fibers at least partially re-erect themselves again after leaving the roll gap and this is associated with a loss of smoothness and gloss.

One proposal for overcoming this latter difficulty is described in International Patent Application PCT/EP89/00701 published under the International Publication Number WO 90/07027. Here the smoothing of a paper web is effected in the nip of a roll pair under the action of pressure, moisture and heat. The method described is characterized in that the surface of the paper or cardboard web to be smoothed is treated during smoothing in the press, gap or nip at a temperature above the glass transition temperature of the material, and in that the paper or card web is then cooled after leaving the press gap or nip to a temperature and moisture content beneath the glass transition point of the material within a time of 20 to 60 milliseconds of leaving the press gap. The specification thus aims at reducing the increase in roughness of the paper web after it has been smoothed in the press gap or nip between the heated rolls. The cooling of the surface of the web can be effected by contact with a chilled surface or by direct contact with a cooling gas.

A process of this latter kind admittedly represents a substantial improvement over the prior art proposals but is nevertheless still associated with certain disadvantages. In order to effect the cooling within a short time interval at a high speed of the web the cooling device must be moved fairly close to the heated rolls. To prevent heat transfer from the rolls to the cooling device it can be necessary to insert partition walls or shields between the rolls and the cooling device. This can result in a congested arrangement which can hinder servicing and repair work. Moreover the problem still exists that it is necessary to provide heated rolls, and heated rolls are in their own right somewhat problematic since hot fluid or gas is invariably required in the interior of the rolls to keep them at the correct surface temperature, thus giving rise to considerable safety problems. Outside heating of rolls is also known but requires space for the heating apparatus and enlarges the space between the heating rolls and neighboring apparatus. In addition heated rolls can suffer local distortion and temperature differences as a result of their design and these can in turn lead to marking of the surface of the paper web.

The principal object underlying the present invention is to provide a method and a corresponding apparatus for the generation of smoothness and gloss on paper which essentially precludes a re-erection of fibers after the smoothing process and which also provides freedom in the design of the heating apparatus that is required, so that, if the designer wishes, heated rolls can be avoided in the realization of the invention.

BRIEF DESCRIPTION OF THE INVENTION

In accordance with a first aspect of the invention the above object is satisfied method-wise in that at least one surface of the paper web is heated in a first step to a temperature above the glass transition temperature of the fibers at said surface of the web and is subjected in a second step to pressure and shock cooling simultaneously whereby to deform the fibers at the surface of the web to generate the desired smoothness and gloss while cooling the said surface from a temperature above the glass transition temperature to below the glass transition temperature, whereby to fix the deformed fibers in the deformed state to retain the desired smoothness and gloss.

Apparatus-wise the present invention provides apparatus for generating smoothness and gloss at the surface of a paper web comprising cellulose fibers, the apparatus being characterized in that a heating device is provided for heating at least one surface of the paper web to a temperature above the glass transition temperature; and in that a cooled body is provided after the heating device as well as means for pressing the cooled body against the surface to simultaneously deform the fibers into a deformed state to generate smoothness and gloss and to fix them in said deformed state by cooling them to a temperature below the glass transition temperature.

It can be seen from the foregoing that the method and apparatus of the present invention thus go in a completely different direction from the prior art proposals. In the present invention the pressure applied to the web is applied simultaneously with the cooling thereof so that the surface smoothness and gloss generated by pressing is effectively "frozen" into the surface of the web at the instant at which it is generated so that there is substantially no longer any danger of the fibers at the surface partially re-erecting themselves after smoothing.

At this stage reference should also be made to British patent specification 1 540 056 which describes a method and apparatus for continuously consolidating and surface finishing a paper web. However, substantially all the fibers of the web treated in this British specification are of a synthetic thermoplastic material. Such fibers are understood to be true synthetic fibers formed by extrusion of a synthetic thermoplastic material into endless solid, i.e. non-hollow, filaments which are subsequently chopped to form bulk synthetic fibers for consolidation into a synthetic paper web. Such synthetic paper webs are usually encountered as a special plastic paper of high tear strength and printable for the manufacturing of driving licenses, passports etc. The method/apparatus of British patent specification 1 540 056 involves the steps of heating the web to a temperature above the softening point of the synthetic thermoplastic material. During this the web is supported throughout the time it is above the softening point of the thermoplastic material, because the web has substantially no coherence, i.e. no strength. After the web has been softened throughout it is subsequently cooled from a temperature above the softening point of the synthetic thermoplastic material while in contact with a forming surface, so that the finish of the forming surface is imparted to the surface of the web without subjecting the web to substantial pressure.

In the first instance it will be noted that the reference is quite clearly concerned with paper webs substantially all the fibers of which are of a synthetic thermoplastic material, rather than being concerned with cellulose fiber webs to which the present invention is directed. There is a substantial difference between a true thermoplastic material such is used in the citation and the natural cellulose fiber material of the present invention. Such thermoplastic synthetic fibers are solid at room temperature but soften to a flexible but weak state. That is to say they loose their strength and become physically deformable at high temperatures. The present invention clearly concerns paper webs in which the predominant component is natural cellulose fibers.

The natural cellulose fiber material of the present invention is, as noted above, cellulose fiber material as commonly encountered in the papermaking industry with hollow fibers derived from raw materials such as wood, grass, cotton, sugar cane (bagasse), reed and bambus and optionally containing recycled raw material from the same type or types of source.

Moreover, the citation makes it clear that the consolidation of the web is due to the action of heat rather than of pressure. In this respect it is explained that although the resilient surface of the transfer roll gently presses the web against the surface of the cooling roll the pressure is much less than that used in conventional hot pressing processes. The gentle pressure applied by the British specification to the web serves solely to ensure that the web is in good contact with the roll surface but not to squeeze the sheet itself. The way in which the surface finish is imparted to the web is said to be analogous to a casting process, in that the softened thermoplastic material "flows" and thereby accurately adopts the finish of the supporting surface. It is also noted that the citation aims at softening the web throughout its thickness to reduce the temperature gradient through the web when the web is being heated to a temperature above the softening point of the thermoplastic material. The need to support the web in the reference is explained by the comment that if the web were unsupported when above or very near the softening point, it would be likely to break, stretch or be otherwise deformed, because of little coherence in that state.

In the system of the invention the increase in temperature of the surface or surfaces of the web should preferably take place very rapidly and should also preferably be essentially restricted to the surface or surfaces of the web in order to reduce the volume reduction of the paper web during the subsequent pressure and cooling treatment which leads to the flattening and bonding. In practice this is very difficult to achieve in prior art processes because of the limited dwell time available for this purpose in high speed machines, and this is a disadvantage of all prior art proposals where "shock" heating of the web is intended. Thus, the present invention does not use a press nip while heating the web.

As indicated earlier no particular constraints are placed on the heating device that is used for the present invention. Thus any of the known heating devices can be used, such as radiative heating devices or heated rolls. Because the transfer of the heat to the surface of the web does not have to take place over a short length in a roll gap at a high speed of the paper web, but can rather take place over a substantial angular extent of the heated surface of the heated roll, the temperature of the heated roll need not be as high as in the prior art, because more time is available for heat transfer, so that the safety problems and technical problems of the hot pressure roll are substantially reduced.

By way of example, if one wishes to rapidly heat a web at ambient temperature to 150° C. using prior art apparatus one would need a hot roll surface temperature much above 200° C. which makes the design of such rolls very complicated and risky. In contrast the invention utilizes for the first time "shock cooling". Here the web which is already at 150° C., and which may have been heated to this temperature relatively slowly with a relatively cool heat source only slightly above 150° C., is cooled abruptly, as it were with a step change in temperature to 120° C., and for this purpose a roll pair can be used close to ambient temperature. This kind of roll is much safer and easier to handle than the hot rolls required by the prior art.

To increase the effectiveness of the two method steps, i.e. heating and cooling, with the application of pressure it can be convenient to arrange a thermally insulating device between the heating device and the cooled body.

Particular embodiments of the invention are set forth in the subordinate claims and it suffices to specifically mention that the pressure which is applied to the surface of the paper web can be achieved in various ways, for example in the form of contact pressure when realizing the cooling device as a pair of rotatable rolls. In this case the contact pressure is generated in the roll gap. The heating of the paper web can arise through deflection of the paper web over a rotatable or static body. With a static body there is a considerable relative sliding between the surface of the web and the body which itself generates a smoothing effect and heating. With a rotatable body the speed of rotation of the body can be controlled so that the surface speed of the body is lower than the surface speed of the paper web. Again slippage takes place between the two surfaces, i.e. of the body and of the confronting surface of the paper web, with a corresponding heating action. Alternatively the heating of the web can be arranged by use of a heated roll or roller with the paper web extending over the surface thereof to a considerable angular extent. Radiative heating can also be used. The person skilled in the art is thus given considerable freedom in the specific design of the apparatus required to carry out the method, with respect to the heating arrangement.

BRIEF DESCRIPTION OF THE DRAWINGS

The invention will be explained in the following in more detail with reference to two embodiments in the accompanying drawings which show.

DESCRIPTION OF PREFERRED EMBODIMENTS

Figure 1:
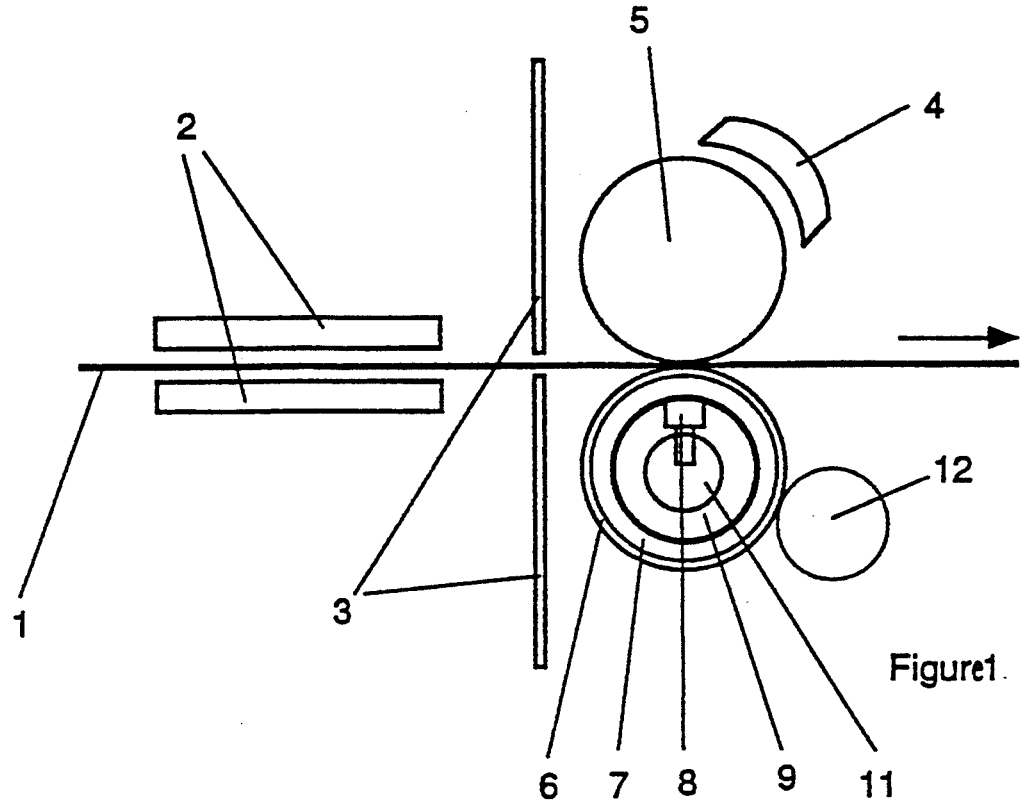
FIG. 1 is a schematic sideview of the apparatus using rotatable rolls as the cooling apparatus.

Both embodiments have in common that the surface of the paper web 1 is heated via heating devices 2 arranged on both sides of the web and operating for example on the basis of thermal radiation (FIG. 1) or heated rolls (FIG. 2) to a temperature above the glass transition temperature of the natural cellulose fibers and the surface of the web. As is clearly shown in the drawings, the paper web is not subjected to a press nip during the heating step. This enables the fibers to be deformed and to retain the deformed state during the subsequent bonding of these surface fibers in the subsequent pressure and cooling treatment. In the arrangement of FIG. 1 thermally insulating means 3 in the form of partition walls adjoin the heating devices 2. The actual smoothing and gloss generating step which leads to bonding or fixing of the surface fibers in the smooth glossy state is realized via cooled rolls 5 and 9, respectively, which press against the surface of the paper web 1.

In the design illustrate in FIG. 1, the two cooled bodies 5 and 9 are formed as rotatable rolls which form a roll gap and which are pressed against one another. The one roll 5 is executed as a conventional metallic solid or hollow roll, because of the thermal conductivity, while the other roll 9 is built-up for the regulation of the thickness profile of the paper web 1 as a roll controlled with respect to deflection or shell deflection. This roll has a rotationally fixed carrier 11 and a roll jacket 7, 6 which is rotatable about the carrier 11 and which is braced relative to the carrier by at least one support element 8 which exerts a supporting force in the press plane. Such rolls controlled with respect to deflection or shell deflection are well known in the art. The roll jacket consists in the illustrated arrangement of an inner zone 7 with low thermal conductivity and an outer, preferably metallic zone 6, with good thermal conductivity. This offers the possibility of a flexible regulation of the support forces via the roll width and also an adequate ability to pick-up or give-up heat. The cooling of the one roll 5 takes place by means of a cooling device 4 which extends over a part of the roll surface, with the cooling device having cooling gas nozzles through which a cooling gas is directed onto the roll surface. In contract to this, the other roll is cooled via contact with a preferably cambered or crowned cooling roll 12, to ensure uniform pressure.

Figure 2:
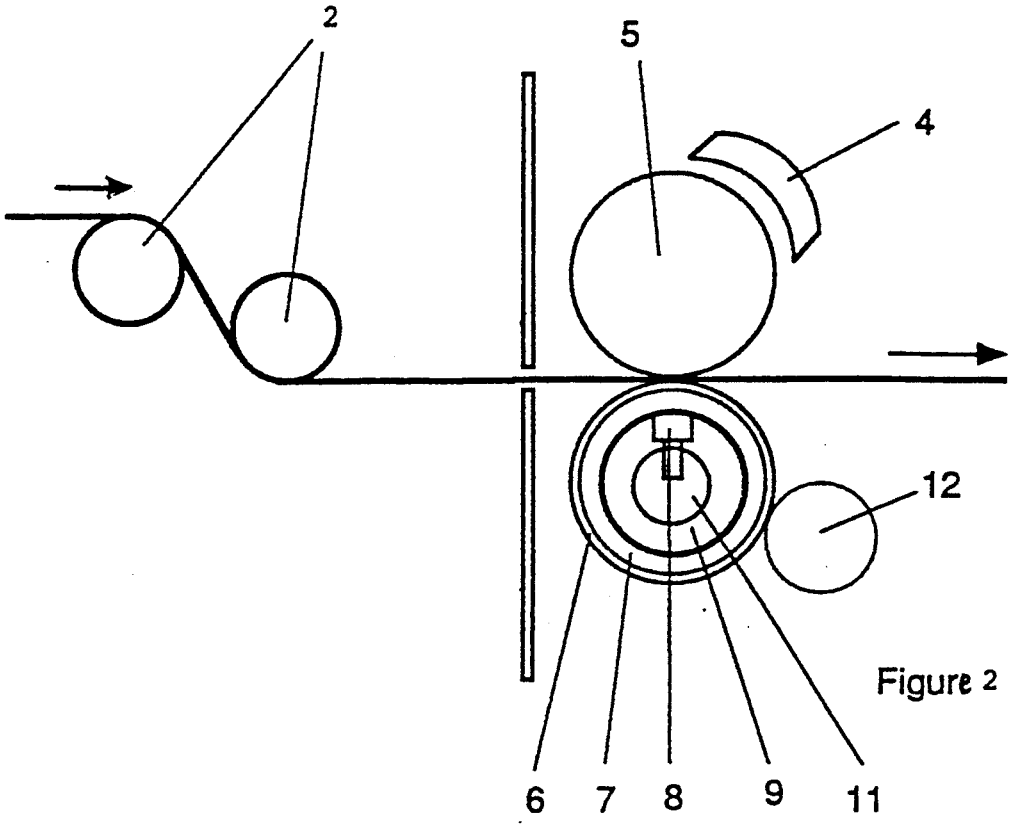
FIG. 2 is a schematic sideview of the apparatus using the rotatable or static bodies as the heating apparatus.

In the other embodiment shown in FIG. 2, the heating device 2 is rotatably or statically arranged. This heating device 2 comprises two rolls each of which has a metal jacket and each of which is flowed through by a heating medium, typically in such a way as to maintain the roll surface at slightly above 150° C. Alternatively, or additionally, the friction which occurs with a relative speed between the surfaces of the rolls and the paper web 1 contributes to the generation of heat to raise the web above the glass transition temperature which is important for the subsequent generation of the smoothment and gloss. It will be appreciated that the degree of heat generated by friction depends on the extent of slippage between the rolls 2 and the paper web.

We claim:

1. A method of treating a paper web to produce at least one side having smoothness and gloss, the web comprising predominantly natural cellulose fibers having a glass transition temperature, the method comprising the steps of heating said paper web to a temperature above said glass transition temperature without subjecting said paper web to a press nip, followed substantially immediately by pressing the paper web while its temperature is above said glass transition temperature against a surface having a temperature below said glass transition temperature to thereby simultaneously generate said smoothness and gloss by deforming said natural cellulose fibers in said at least one side while said paper web is still at a temperature above said glass transition temperature and fix deformed fibers in said at least one side of the paper web in their deformed state by lowering their temperature to below said glass transition temperature to retain the smoothness and gloss of said at least one side attained when the paper web is first pressed against the surface.

2. Method in accordance with claim 1, wherein the natural cellulose fibers are essentially hollow fibers selected from the group consisting of wood, grass, cotton, bagasse, reed, bambus and recycled cellulose material.

3. Method in accordance with claim 1, wherein a moisture content of said paper web entering said pressure and shock cooling step at a temperature above the glass transition temperature lies between 2 and 10% by weight.

4. Method in accordance with claim 3 wherein said moisture content of said paper web entering said pressure and shock cooling step at a temperature above said glass transition temperature lies between 5 and 7% by weight.

* * * * *